US005105540A

United States Patent [19]

Rhodes

[11] Patent Number: 5,105,540

[45] Date of Patent: Apr. 21, 1992

[54] TUBE METHOD OF MAKING A COMPOSITE HEAT EXCHANGER TUBE

[75] Inventor: Eugene E. Rhodes, Belleville, Mich.

[73] Assignee: Ford Motor Company, Dearborn, Mich.

[21] Appl. No.: 770,755

[22] Filed: Oct. 4, 1991

Related U.S. Application Data

[60] Continuation of Ser. No. 592,437, Oct. 4, 1990, abandoned, which is a division of Ser. No. 251,420, Sep. 30, 1988, Pat. No. 4,982,784.

[51] Int. Cl.[5] ..... B21D 53/02

[52] U.S. Cl. ..... 29/890.043; 29/890.049; 29/890.053; 228/183

[58] Field of Search ..... 29/890.043, 890.049, 29/890.053, 890.054; 165/177, 179, 181; 228/183

[56] References Cited

U.S. PATENT DOCUMENTS

| | | | |
|---|---|---|---|
| 813,918 | 2/1906 | Schmitz | 138/38 X |
| 1,881,610 | 10/1932 | Hyde | 165/179 |
| 2,096,272 | 10/1937 | Young | 165/179 |
| 2,480,706 | 8/1949 | Brinen | 165/179 |
| 2,930,405 | 3/1960 | Welsh | 138/38 |
| 3,154,141 | 10/1964 | Huet | 165/181 |
| 3,267,563 | 8/1966 | Seaton | 138/38 X |
| 3,734,135 | 5/1973 | Mosier | 165/177 |
| 3,809,155 | 5/1974 | Anthony et al. | 165/133 |
| 3,875,997 | 4/1975 | Newson et al. | 165/179 |
| 3,906,605 | 9/1975 | McLain | 165/177 |
| 4,470,452 | 9/1984 | Rhodes | 165/179 |
| 4,878,925 | 11/1989 | Kojima | 55/235 |

FOREIGN PATENT DOCUMENTS

| | | | |
|---|---|---|---|
| 55-43360 | 3/1980 | Japan | 138/38 |
| 0050211 | 3/1982 | Japan | 29/890.053 |
| 0011388 | 1/1983 | Japan | 29/890.053 |
| 0140596 | 8/1983 | Japan | 29/890.053 |
| 0099718 | 4/1989 | Japan | 29/890.053 |
| 0804669 | 6/1981 | U.S.S.R. | 29/890.053 |
| 1009973 | 11/1965 | United Kingdom | 165/109.1 |

*Primary Examiner*—Irene Cuda

*Attorney, Agent, or Firm*—Jerome R. Drouillard; Roger L. May; Raymond L. Coppiellie

[57] ABSTRACT

A method for fabricating a composite tube for a heat exchanger includes the steps of feeding tube stock and liner stock into a tube mill, superimposing liner stock upon the tube stock and simultaneously forming the tube stock into an outer tube while forming the liner stock into a lining within the tube. The tube is then welded or brazed longitudinally and the liner is brazed to the outer tube.

8 Claims, 1 Drawing Sheet

TUBE METHOD OF MAKING A COMPOSITE HEAT EXCHANGER TUBE

This is a continuation of copending application Ser. No. 07/592,437 filed on Oct. 4, 1990 entitled: METHOD OF MAKING A COMPOSITE HEAT EXCHANGER TUBE, abandoned, which is a divisional application Ser. No. 251420 filed Sep. 30, 1988, now U.S. Pat. No. 4,982,784 entitled: COMPOSITE HEAT EXCHANGER TUBE.

BACKGROUND OF THE INVENTION

1. Field of the Invention

This invention relates to a composite tube for use in heat exchangers.

2. Disclosure Information

Designers of heat exchangers must consider a number of interconnected performance factors. For example, high heat transfer efficiency is promoted by turbulent flow within the fluid conducting tubes of the heat exchanger. However, such turbulence is usually achieved only at the cost of a high pumping loss, which may necessitate the use of considerable power to move fluid through the heat exchanger device. If, on the other hand, fluid is allowed to flow through the heat exchanging tubes in a quiescent manner, stratification will occur and the efficiency of the unit will be diminished.

Heat exchanger designers have employed a variety of methods for increasing turbulent flow through the tubes of heat exchangers. One familiar technique involves the insertion of an additional element into the tube so as to promote turbulent flow. U.S. Pat. Nos. 2,096,272; 2,480,706 and 3,734,135 all disclose inserted turbulence promoting devices. French Patent 702,989 and British Patent Specification 1,016,573 disclose additional types of inserted turbulence promoting elements Each of the cited examples of turbulence promoting elements suffers from a common drawback inasmuch as additional expense in the form of both labor and material is required to insert the turbulator strips into the partially finished tube assemblies. An additional drawback resides in the fact that with certain metals such as aluminum, corrosion of the tube material is promoted by the formation of crevices at the intersections of the turbulence promoting devices and the interior surfaces of the outer tube walls. This so-called crevice or poultice corrosion is particularly bothersome with aluminum radiator tubes. It is an object of the present invention, then, to avoid the added labor costs usually associated with producing heat exchanger tubes having a turbulence promoting feature, while at the same time avoiding corrosion problems.

Heat exchanger designers have attempted to avoid drawbacks associated with separate turbulator inserts by providing integral turbulence promoting features in heat exchanger tubes. U.S. Pat. Nos. 1,881,610; 3,154,141; 3,875,997; 3,906,605 and 4,470,452 as well as French Patent 1,336,583 and Japanese Patent 59-41795 all disclose heat exchanger tube structures in which the tube wall is worked in order to provide a turbulence promoting feature such as a plurality of indentations formed in the wall. Such structures suffer from two potential drawbacks. First, in the event that the tube wall is of sufficient thickness so as to withstand the roughening process without resulting in any distortion of the outer surface of the tube, the heat transfer characteristics of the tube will be somewhat impaired by the thickness of the wall itself. Furthermore, the expense of the tube material will be increased because of the thicker wall. If, on the other hand, a thin wall tube is used such that the roughening turbulator structure appears not only on the inner wall of the tube but also on the outer wall of the tube, another problem results. Such a construction, featuring a plurality of indentations in the tube wall, is shown in the '452 patent, which is assigned to the assignee of the present invention, and which is hereby incorporated by reference herein It has been determined that a turbulator radiator tube according to the '452 patent may be joined to the header tanks of the heat exchanger only with difficulty when certain brazing processes are used because the turbulence-promoting indentations in the tube wall are difficult to fill with brazing material, and leaks result in the finished heat exchanger. This necessitates an additional sealing process, which materially increases the cost of the heat exchanger.

It is object of the present invention to provide a method for making a composite heat exchanger tube which does not need for a separate turbulence producing insert but which nevertheless provides good heat transfer characteristics.

It is yet another object of the present invention to provide a method of making a composite heat exchanger tube which may be easily processed during the assembly of a heat exchanger employing such a tube.

It is an advantage of the present invention that a tube the method of making will result in which will be resistant to crevice or poultice corrosion.

It is yet another advantage of the present invention that a composite heat exchanger tube according to this invention may be fabricated without additional labor costs associated with other types of turbulence promoting heat exchanger tubes.

It is yet another advantage of the present invention that a composite heat exchanger tube made according to this invention will have superior mechanical strength as compared to other types of heat exchanger tubes.

It is yet another advantage of the present invention resides in the fact that a composite heat exchanger tube made according to the present invention has a smooth exterior surface which is easily joined to a heat exchanger header component by conventional brazing or welding methods.

Other objects, features and advantages of the present invention will become apparent to the reader of this specification.

SUMMARY OF THE INVENTION

According to the present invention, a composite heat exchanger tube comprises a liner having surface variations which promote turbulence of liquid flowing through the tube and an outer tube telescoped about the liner and joined to the outer tube. The liner and tube may be joined by brazing, where a brazing material is either placed separately from the liner and outer tube or supplied by means of a cladding applied to the parent metal of the outer tube. The liner and outer tube are preferably formed simultaneously in a tube mill. The inner surface of the liner may be marked by a plurality of turbulence promoting depressions; alternatively, a plurality of turbulence promoting apertures may be formed in the liner. According to another aspect of the present invention, a method for fabricating a composite tube for a heat exchanger includes the steps of: (i) feeding tube stock and liner stock into a tube mill; (ii) superimposing the liner stock upon the tube stock; and (iii) simultaneously forming the tube stock into an outer tube while forming the liner stock in a lining within the outer tube. A method according to the present invention may further include welding of a longitudinal seam along the outer tube to complete the fabrication of the outer tube. Finally, the outer tube will be brazed to the liner.

According to yet another aspect of the present invention, a method for fabricating a heat exchanger having composite tubes comprises the steps of feeding tube stock and liner stock into a tube mill, forming the tube stock into an outer tube, forming the liner stock into a telescoped lining within the outer tube, welding a longitudinal seam along the outer tube, assembling the composite tube preform into the headers of a heat exchanger and brazing the outer tube into the headers while simultaneously brazing the liner to the outer tube. Thus, a heat exchanger according to the present invention may comprise a pair of headers receiving a plurality of heat exchanging tubes, with each header having an end tank attached thereto, and with each of said tubes comprising a turbulence promoting liner and an outer tube telescoped about said liner and brazed thereto.

DETAILED DESCRIPTION OF THE PREFERRED EMBODIMENTS

Figure 1:
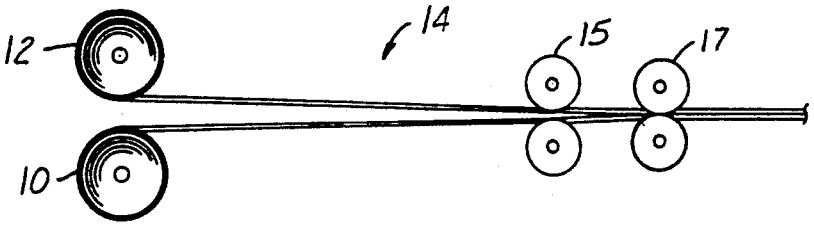
FIG. 1 is a schematic representation of a tube mill for making a composite heat exchanger tube according to the present invention.

As shown in FIG. 1, a composite heat exchanger tube according to the present invention is intended to be fabricated from separate rolls of tube stock 10, and liner stock 12. The rolls of flat stock are fed into the rollers of tube mill 14, wherein the liner and the outer tube according to the present invention are formed simultaneously.

Upon being fed into the tube mill, liner stock 12 is superimposed upon tube stock 10. Accordingly, the telescoped structure of the completed tube is a direct result of the basic fabrication process described herein, as opposed to being the result of an additional step involving insertion of a turbulator structure into an already finished outer tube. The term "telescoped" is used conventionally herein to describe the nesting relationship between the outer tube and liner. As will be appreciated from FIGS. 2 and 3, the width of the strip or coil comprising tube stock 10 is wider than that of liner stock 12. As a result, liner 20 does not extend all the way to free ends 18 of outer tube 16. This prevents liner 20 from interfering with free ends 18 of outer tube 16 during the welding of longitudinal seam 22, which may be done according to a conventional high frequency welding process or other welding process known to those skilled in the art and suggested by this disclosure.

Figure 2:
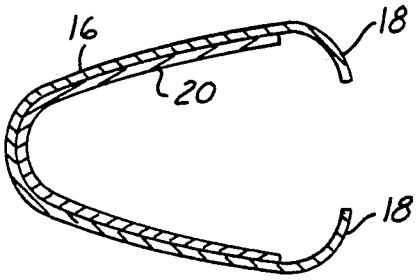
FIG. 2 illustrates a composite tube preform during the initial processing of tube stock and liner stock in a tube mill according to the present invention.

A tube according to the present invention is shown in an intermediate state in FIG. 2. The V-shaped structure shown in FIG. 2 is formed by a set of V-shaped rollers, 17, within tube mill 14. Note that FIG. 2 clearly shows that liner 20 does not extend all the way to free ends 18 of outer tube 16, which are formed by edge rollers 15. The balance of tube mill 14 is conventional and is therefore not shown.

Figure 3:
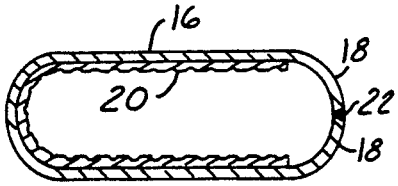
FIG. 3 is a cross-sectional view of a finished tube according to the present invention.

The final preform of a tube according to the present invention is shown in FIG. 3. Note that weld 22 has been applied along a longitudinal seam of outer tube 16 to complete the fabrication of the outer tube. All that remains to complete the tube of the present invention from the state in FIG. 3 is brazing of the liner to the outer tube so that brazing alloy will fill the annular space defined by the mating surfaces of outer tube 16 and liner 20. This brazing may be facilitated if the tube stock comprises metal clad with a brazing material. More specifically, a composite tube according to the present invention may include an outer tube made of aluminum clad with a brazing alloy and a liner made of aluminum without braze cladding.

Once liner 20 has been assembled within outer tube 16, the assembly may be furnace brazed or brazed by some other means such as induction brazing. In any event, brazing of liner 20 to outer tube 16 is facilitated if the liner is fabricated of metal which is tempered so as to be more resilient prior to the brazing process. This will allow the liner to press against the inner surfaces of the walls of outer tube 16, thereby tending to take up any gap between the liner and the inner surfaces of the tube.

The liner and the outer tube may preferably be comprised of SAE 3003 aluminum alloy clad with SAE 4343 brazing alloy, with the liner comprising H18 cold rolled stock. For an automotive radiator of the type shown generally in FIG. 5, liner 20 will preferably comprise material which is very thin, in the range of 0.003–0.004 inches in thickness. Those skilled in the art will appreciate in view of this disclosure that other types of metals clad with other types of brazing or soldering agents could be employed in a composite tube according to the present invention. Further, liner 20 may be made of a sacrificial material such as a zinc containing alloy or other alloy known to those skilled in the art and suggested by this disclosure.

Figure 4:
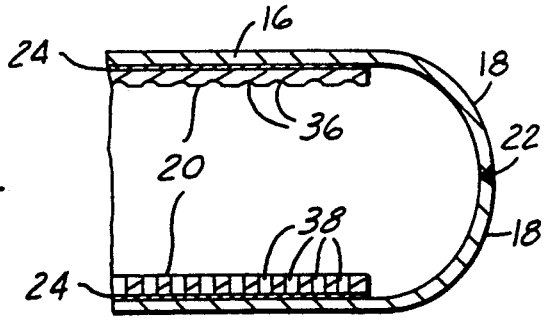
FIG. 4 is an enlarged fragmentary view of a section of a tube according to the present invention.

FIG. 4 illustrates a fragmentary section of a composite tube according to the present invention following the brazing process. Note that brazed joint 24 fills substantially the entire annular gap defined by liner 20 and outer tube 16. This fact is important because complete filling of the space between the turbulator lining and the outer tube will effectively prevent crevice or poultice corrosion from occurring in the space between the telescoped parts. FIG. 4 further illustrates a plurality of indentations, 36, formed in the inner surface of liner 20. Alternatively, FIG. 4 also shows a plurality of apertures, 38, formed through liner 20. Indentations 36 and apertures 38 comprise surface variations whose purpose is to promote turbulence in a liquid flowing through the tube described herein. Accordingly, liner 20 is properly termed a "turbulator lining".

Figure 5:
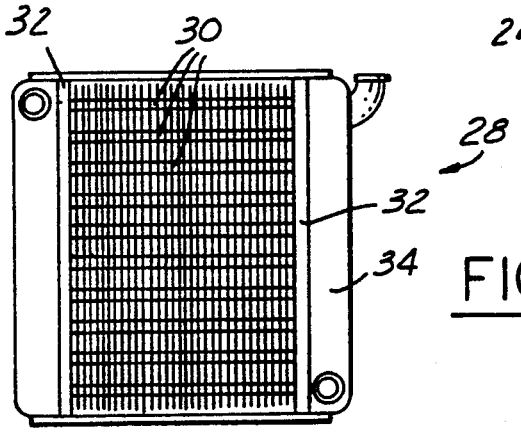
FIG. 5 is a partially schematic view of a heat exchanger according to the present invention.

FIG. 5 illustrates a heat exchanger assembly fabricated with composite tubes according to the present invention. According to a method for constructing a heat exchanger, a plurality of unbrazed composite tube preforms, 30, will be inserted into a pair of headers, 32. The resulting combination of the tubes and headers as well as fins, if desired, may be then brazed in a furnace. This will allow the outer tubes to be brazed into the headers while simultaneously brazing the liners to the outer tubes. Because the outer tubes have smooth, untextured exterior surfaces, brazing of the tubes into the headers will be easily accomplished even with the use of braze clad material for outer tubes 16. Once the brazing has been completed, end tanks 34 may be added to complete the heat exchanger assembly.

Various modifications and variations will no doubt occur to those skilled in the arts to which this invention pertains. All such modifications and variations which basically rely on the teachings with which this disclosure has advanced the art are properly considered within the scope of this invention as defined by the appended claims.

What is claimed is:

1. A method for fabricating a composite tube for a heat exchanger, comprising the steps of:

feeding tube stock and liner stock into a tube mill;

superimposing said liner stock upon said tube stock;

simultaneously forming said tube stock into an outer tube having an interior surface while forming said liner stock into a lining telescoped within said tube, said lining having an exterior surface configured to be joined to said interior surface of said tube along substantially the entire exterior surface of said lining;

welding a longitudinal seam along said outer tube to complete the fabrication of said outer tube; and brazing said outer tube to said lining so that substantially the entire exterior surface of said lining is joined to said interior surface of said tube.

2. A method for fabricating a composite tube according to claim 1, wherein said tube stock comprises metal clad with a brazing material.

3. A method for fabricating a composite tube according to claim 1, wherein said tube stock comprises aluminum clad with a brazing material.

4. A method for fabricating a composite tube according to claim 1, wherein said liner stock comprises a sacrificial metal having a plurality of indentations formed therein.

5. A method for fabricating a heat exchanger having composite tubes, comprising the steps of:

feeding tube stock and liner stock into a tube mill;

forming said tube stock into an outer tube and forming said liner stock into a telescoped turbulator lining within said outer tube;

welding a longitudinal seam along said outer tube;

assembling said composite tube preform into the headers of a heat exchanger; and brazing said outer tube into said headers while simultaneously brazing said liner to said outer tube.

6. A method for fabricating a heat exchanger according to claim 5, wherein said tube stock comprises metal clad with a brazing material.

7. A method for fabricating a heat exchanger according to claim 5, wherein said tube stock and said headers comprise aluminum clad with a brazing material.

8. A method for fabricating a heat exchanger according to claim 5, wherein said brazing is performed in a furnace.

* * * * *